United States Patent [19]

Akabame et al.

[11] 4,289,301

[45] Sep. 15, 1981

[54] POST FOR A GUARD RAIL

[75] Inventors: Noboru Akabame, Tama; Hitoshi Yoshino, Tokyo, both of Japan

[73] Assignee: Nippon Light Metal Company Limited, Tokyo, Japan

[21] Appl. No.: 83,168

[22] Filed: Oct. 9, 1979

[30] Foreign Application Priority Data

Oct. 13, 1978 [JP] Japan ..... 53-125091
Jan. 31, 1979 [JP] Japan ..... 54-10009

[51] Int. Cl.[3] ..... E01F 15/00
[52] U.S. Cl. ..... 256/13.1; 256/19
[58] Field of Search ..... 256/13.1, 19; 248/66

[56] References Cited

U.S. PATENT DOCUMENTS

| | | | |
|---|---|---|---|
| 2,907,552 | 10/1959 | Crone | 256/13.1 |
| 2,969,223 | 1/1961 | Hansen | 256/13.1 |
| 3,028,148 | 4/1962 | Crannell | 256/13.1 |
| 3,262,240 | 7/1966 | Schuman et al. | 256/13.1 UX |

*Primary Examiner*—Andrew V. Kundrat
*Attorney, Agent, or Firm*—McAulay, Fields, Fisher, Goldstein & Nissen

[57] ABSTRACT

A post for a guard rail used on a highway. Said post is made of an aluminum cast alloy, and is formed in an I-shape in a horizontal cross section, having a central web and front and rear flanges, and being wider at its lower portion. A mechanical neutral plane of the post along the widthwise direction thereof is formed in an S-shape, so as to provide sufficient plasticity and supporting ability to absorb an impact load of a vehicle and to protect a driver from injury.

15 Claims, 7 Drawing Figures

POST FOR A GUARD RAIL

SUMMARY OF THE INVENTION

The present invention relates to a guard device, and is particularly concerned with an improved post construction for a guard rail, such as used on a highway or the like. It will be noticed that the post of the present invention is not intended to be used for a pedestrian safety fence.

It is well known that the guard device is used as a certain kind of road-criterion to persons operating vehicles. The guard device is required to absorb and reduce the impact of the vehicle so as to minimize injury to the driver and the occupants should a vehicle in motion contact or collide with the guard rail. In a case where a vehicle in motion contacts a guard rail, it is desirable that such guard rail has no obstacles on the surface thereof facing the highway, in other words, the post for the guard rail sould not protrude from the guard rail toward the highway. For this reason, at the present time, the Block-out Type (i.e., the type in which the guard rail protrudes from the post toward the highway) can be considered as a most suitable one.

In view of recent traffic circumstances in Japan, a post for a guard rail is required to provide a plastic deformation of more than 300 mm in a horizontal direction when 5 tons of horizontal load is applied at the top of the post, as well as providing a high supporting ability capable of holding a bending moment of 2 tons or slightly more times post height at 300 mm of horizontal deformation of the post.

According to our repeated tests, it was confirmed that the post of the present invention can be effectively utilized for a guard rail which requires such severe safety standards and high performance.

One object of the present invention is to provide a post for a guard rail which has sufficient plasticity and supporting ability to absorb the impact load of a vehicle, and to protect the driver from injury.

Another object of the present invention is to provide a post for a guard rail which does not spoil the beauty of the area.

The present invention provides a post for a guard rail to be secured on a curb arranged at a side of a highway, so as to support at least one guard rail extending lengthwise along the highway. According to the present invention, the post is comprised of a post body formed approximately in an I-shape, with front and rear flanges formed on the front and rear portions, respectively, of a wall or web, said front flange facing the highway, a cross sectional area of the post body taken on a horizontal plane increases in width from top to bottom, a baseplate being formed at the bottom of said post body so as to be secured to said curb, an upper mounting recess for an upper guard rail being provided on the top portion of said front flange, at least one lower mounting recess for at least one lower guard rail being provided at the middle portion of said front flange, and a mechanical neutral plane of the post along the widthwise direction of the post being formed in a wave-shape, in which the mechanical neutral plane portion positioned above the lower mounting recess is upwardly inclined from said recess toward the highway along a gentle curve, and the neutral plane portion positioned under said recess has a concave curve which inclines deeply toward the highway, thereby as a whole, said waved mechanical neutral plane being formed in an S-shape along the full height of the post.

Preferably, the thickness of the front flange facing the highway is substantially thicker than that of the rear flange, but thinner than that of the baseplate.

Preferably, the thickness of the web portion adjacent to the front flange is substantially thicker than that of the web portion adjacent to the rear flange.

Preferably, the post is made of an aluminum cast alloy.

BRIEF DESCRIPTION OF THE DRAWINGS

Preferred embodiments of the invention will now be described in detail with reference to the accompanying drawings, wherein the same reference numerals are used to designate similar parts throughout the several views, in which.

DESCRIPTION OF THE PREFERRED EMBODIMENTS

Figure 1:
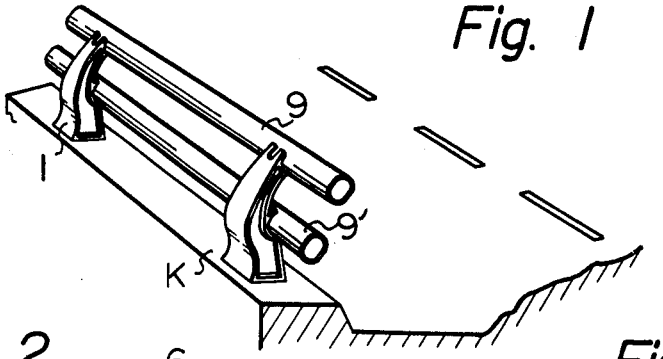
FIG. 1 is a general perspective view of a post according to the present invention.

In FIG. 1, showing a general view of the present invention, a post 1 for guard rails 9 and 9' is secured on a curb or other rigid and fixed part K which is formed by using a mixture of concrete, mortar and gravels. These guard rails may be of any desired shape, those shown being of an ellipse-shape.

The term "curb" is herein employed to designate any rigid or fixed part arranged at a side of a highway.

The post 1 is made of an aluminum cast alloy, preferably a corrosion-resisting aluminum cast alloy containing about 3% by weight of magnesium.

Figure 2:
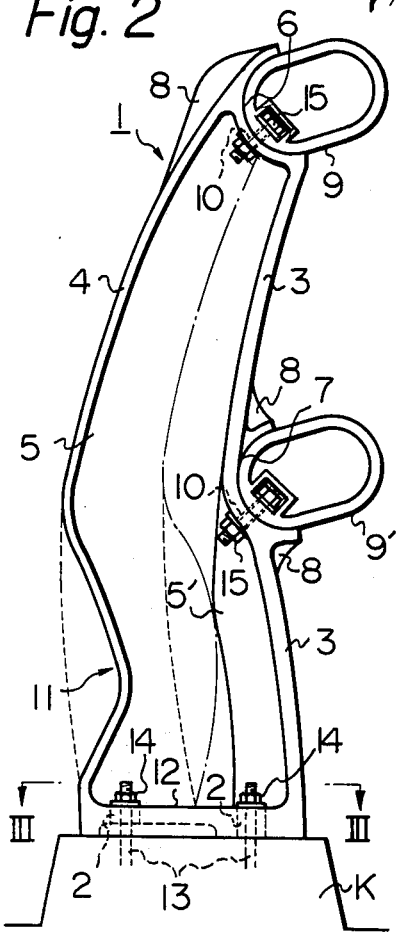
FIG. 2 is an enlarged side view showing an emdodiment of the present invention.

In FIG. 2, showing a side view of an embodiment of the present invention, the post 1 may be secured to the curb in any usual manner; for example, by means of anchor bolts 13 embedded in the curb K and passing through setting holes 2 in the base of the post 1 and secured by nuts 14.

Each post 1 is preferably formed in one piece and is of approximately an I-shape, when a horizontal cross section is taken, having a front flange 3 facing the highway, a rear flange 4 and a central wall or web 5 which interconnects between the front flange 3 and the rear flange 4. The cross sectional area taken on a horizontal plane increases in area from top to bottom. As a result, the section modulus of the post 1 becomes larger toward the base.

Since the impact load of a vehicle is usually applied to the post 1 from the highway side, the thickness of the front flange is made thicker than that of the rear flange, so that a mechanical neutral plane of the post 1 along the widthwise direction thereof is offset toward the front flange 3, i.e., to the highway side.

Since the post is constructed as described above, it will have a sufficient and uniform strength from the top to the bottom thereof, so as to withstand an impact load when said impact load is received at the top of the post. Thus, the large quantity of material used in constructing conventional posts can be reduced by using the construction of the present invention, which in turn results in a lighter weight post.

In order to support the guard rails 9 and 9', each post 1 has on the front surface of the front flange 3 two curved mounting recesses 6 and 7 which are adapted for mounting upper and lower guard rails 9 and 9', respectively. Since the front flange 3 of the post 1 faces the highway, said guard rails 9 and 9' protrude from the post 1 toward the highway, when they are secured in the recesses. The upper and lower guard rails 9 and 9' are secured in the mounting recesses 6 and 7 by means of bolts 15 passing through setting holes 10. The numeral 8 denotes reinforcing ribs for said mounting recesses 6 and 7.

It should be noted that, in the embodiment of the present invention, said mounting recesses 6 and 7 are illustrated as an integral part of the front flange 3; however, any suitable means may be provided for securing said recesses on the front flange.

Also, when reference is made to the mechanical neutral plane of the post, it should be noted that the term "post" is herein employed to designate a post including the post body and the baseplate, but excluding said mounting recesses.

The configuration of the post 1 is an approximate S-shape from a side view, as shown in FIG. 2. The outline of the front flange 3 starting from the upper mounting recess 6 curves towards the rear of the post as it goes down to the position of the lower mounting recess 7, and from this point said outline curves towards the front of the post as it continues down to terminate in the leading-edge of a baseplate 12. The upper half portion of the outline of the rear flange 4 is described almost the same as that of the front flange 3, except that the inclination angle of the front flange 3 is slightly larger than that of the rear flange 4. The lower portion of the outline of the rear flange 4 has a concave curve 11, and said outline terminates in the tail-end of the baseplate 12. In other words, said lower half portion of the outline of the rear flange 4 is deeply curved toward the highway.

As a result, the mechanical neutral plane of the post described above is offset toward the highway and, as a whole, said mechanical neutral plane is formed in an S-shape. As shown by the long and short dotted line in FIG. 2, the length of the mechanical neutral plane of the post according to the present invention is considerably longer than the height of the post 1. In contrast with the above, the mechanical neutral plane of the conventional post is a gentle curve, which is shown in the uniform dotted line in FIG. 2.

According to our experience, it has been found that a conventional post is usually broken at the baseplate thereof, when the impact load is received at the top of the post. In addition, the construction material of said post is a ductile cast aluminum. Reinforcing the post has been carefully considered.

Figure 7:
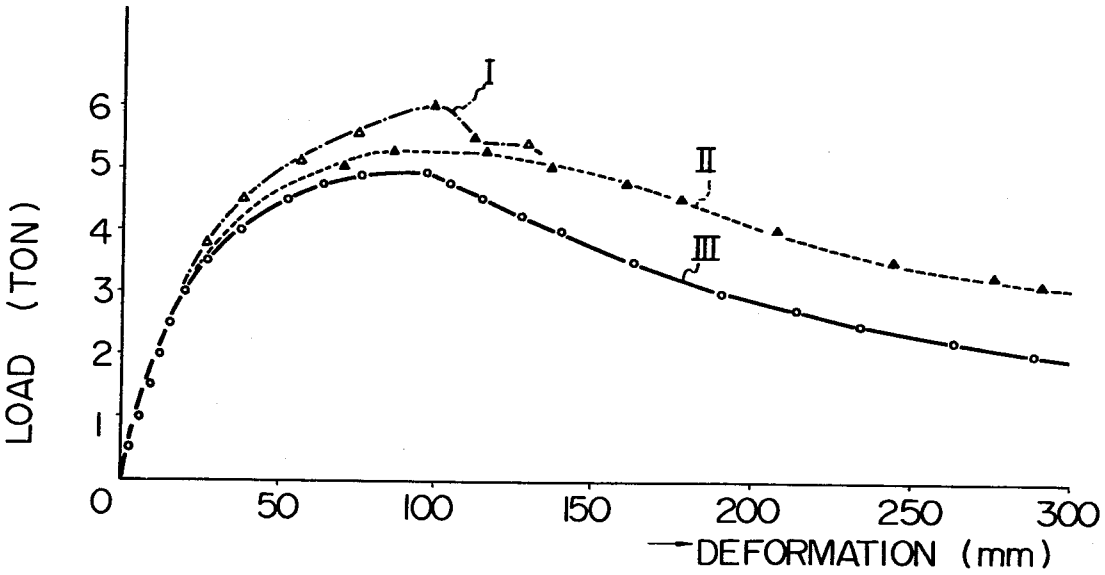
FIG. 7 presents a graph illustrating the deformation of the post versus the applied static load.

FIG. 7 illustrates a comparative graph of static load (ton) versus deformation (mm) of the post. The tested post is 750 mm in height and the static load from a horigontal direction is applied at the top of the post.

A curve I is given for the post in the prior art, in which the mechanical neutral plane is provided with a gentle circular curve. A curve II is given for the post according to the present invention, in which the mechanical neutral plane is provided with an S-shaped curve, but the thickness of the web portion of the post adjacent to the front flange is thicker than that of the web portion adjacent to the rear flange. A curve III is given for the post according to the present invention, in which the mechanical neutral plane is provided with an S-shaped curve, but the thickness of the web is uniformly constructed.

With respect to the curve I, the baseplate of the post near the anchor bolt was broken at 6 tons of static load after being deformed 130 mm thereof. With respect to the curves II and III, the post was not broken and from the point of 5 tons of static load (which is below the breaking point in the curve I) it was plastically deformed by or over 300 mm, and provided a bending moment of 2 tons or slightly more times post height at 300 mm of horizontal deformation of the post. As is seen from the graph, the post of the present invention will fully satisfy the requirement as a guard rail post.

Figure 4:
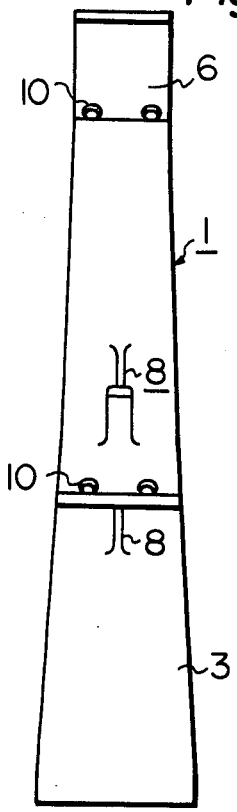
FIG. 4 is a front view of FIG. 2, but the guide rails and the bolts being omitted for purpose of clarity.
Figure 3:
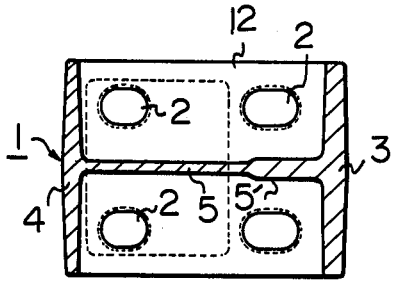
FIG. 3 is a cross-sectional view taken substantially on line III—III of FIG. 2.

In FIGS. 2 through 4, the numeral 5' designates a thicker portion of the web 5 provided between the lower mounting recess 7 and the baseplate 12, said thicker portion 5' being adjacent to the front flange 3.

Figure 5:
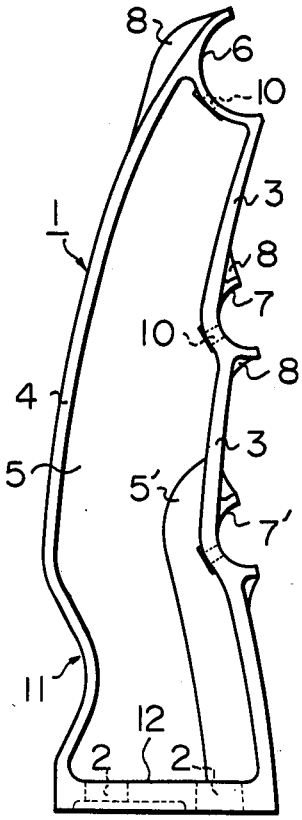
FIG. 5 is an enlarged side view showing another embodiment of the present invention.
Figure 6:
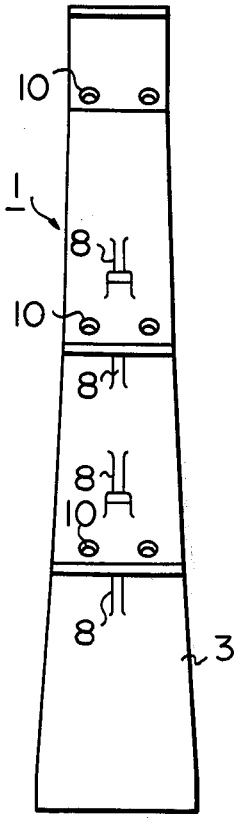
FIG. 6 is a front view of FIG. 5, but the guide rails and the bolts being omitted.

FIGS. 5 and 6 show an embodiment having two lower guard rails as well as a top guard rail. In these cases the numeral 5' denotes a thicker portion of the web 5 provided between the lowest mounting recess 7' and the baseplate 12, said thicker portion 5' being adjacent to the front flange 3.

In order to ensure the driver's safety, the impact of the vehicle should be absorbed and said vehicle should be prevented from continuing beyond the guard rail and the post. To accomplish the above, the post is required to endure more than 300 mm of plastic deformation at the top thereof and to provide a high supporting ability. According to the present invention, the web portion adjacent to the front flange is thicker than that of the remaining portion of the web, so that said supporting ability is greatly increased.

The function of the post for the guard rail according to the present invention is as follows:

As described the above, the position of the neutral plane of the post is offset toward the front flange, so that the distance between the mechanical neutral axis and the front flange is smaller than that of the mechanical neutral axis and the rear flange, when any horizontal cross section is examined. Thus the post will hold sufficient strength to withstand the impact of a vehicle.

Since the configuration of the post is upwardly inclined to the highway, which configuration corresponds to the Block-out type of guard rail, the vehicle will first contact the upper guard rail mounted at the highest position from ground level, and since the post is provided with a large deformability or plasticity and a large supporting ability, the vehicle can be prevented from continuing past the guard rail.

According to the present invention the baseplate is integral with the post body at the bottom end thereof and a plurality of anchor bolts, which are provided at both sides of the web, are used to secure the post to the curb, so that little on site assembling is required.

The thickness of the baseplate is thicker than that of the front flange, so that the post is not weakened by the cutout portions, for example, the setting holes in the baseplate.

The post is made of a corrosion-resisting aluminum cast alloy containing about 3% by weight of magnesium. The deforming property of said aluminum cast alloy is comparatively larger than that of cast iron, which is conventionally used for highway posts. Thus the driver receives some protection from the impact shock should the vehicle collide with the guard rail being held by a post of the present invention. In addition, the corrosion-resisting property of the post will save the painting cost thereof.

Since the post is light in weight, it facilitates both transportation and installation thereof, resulting in low erection costs and reducing the time necessary for installation.

It will be understood that various changes in the details, materials and arrangements of parts which have been herein described and illustrated in order to explain the nature of the invention may be made by those skilled in the art within the principle and scope of the invention, as expressed in the appended claims.

What is claimed is:

1. A post for a guard rail to be secured on a curb arranged at a side of a highway, said post comprising:

a post body formed of metal and having an I-shape in horizontal cross-section with a front flange and a rear flange formed on the front and rear portions of a web;

at least one fitting portion on said front flange facing the highway for receiving said guard rail;

said post having a mechanical neutral plane which is an S-shaped curve; and a first portion of the mechanical neutral plane of substantially the upper half portion of said post body being upwardly inclined towards the highway, and a second portion of the mechanical neutral plane of substantially the lower half portion of said post body having a curved plane protruding towards the highway.

2. The post as claimed in claim 1, in which said rear flange of substantially the lower half portion of said post body is concaved towards the outside of the highway.

3. A post as claimed in claim 1, in which said cross sectional area of substantially the upper half portion of said post body increases in width from the top towards the bottom.

4. The post as claimed in claim 1, 2, or 3, in which said first portion of said mechanical neutral plane is inclined along a straight line.

5. The post as claimed in any one of claims 1, 2, or 3, in which said first portion of said mechanical neutral plane is inclined along a gentle curve.

6. The post as claimed in claim 1, or 2, in which the I-shaped cross sectional area of substantially the lower half portion of said post body increases in width from top to bottom.

7. The post as claimed in claim 1 or 2, including a base plate integrally formed with said post body at the bottom thereof for securement of said post body to the curb.

8. The post as claimed in claim 1, in which the thickness of said front flange facing the highway is thicker than that of said rear flange.

9. The post as claimed in claim 7, in which the thickness of said front flange is thinner than that of said base plate.

10. The post as claimed in claim 1, in which the thickness of the web portion adjacent to said front flange is thicker than that of the web portion adjacent to said rear flange.

11. The post as claimed in claim 10, in which said thick web portion adjacent to said front flange is positioned in a lower portion of said post body.

12. The post as claimed in claim 1, in which said fitting portion is provided with a recess and protruding from the front flange toward the highway.

13. The post as claimed in claim 12, in which one said fitting portion is respectively on the top portion and another fitting portion is on the middle portion of said front flange.

14. The post as claimed in claim 1, in which said post is made of an aluminum cast alloy.

15. The post as claimed in claim 14, in which the aluminum cast alloy is a corrosion-resisting cast alloy containing about 3% by weight of magnesium.

* * * * *